US007073517B1

(12) United States Patent
Burnette, III

(10) Patent No.: US 7,073,517 B1
(45) Date of Patent: Jul. 11, 2006

(54) HAIR TRIMMING GUIDE

(76) Inventor: Travis W. Burnette, III, 1929 Hollyvista Ave., Los Angeles, CA (US) 90027

( * ) Notice: Subject to any disclaimer, the term of this patent is extended or adjusted under 35 U.S.C. 154(b) by 392 days.

(21) Appl. No.: 10/679,118

(22) Filed: Oct. 3, 2003

(51) Int. Cl.
*A45D 24/34* (2006.01)
*A45D 24/38* (2006.01)
*A45D 8/22* (2006.01)

(52) U.S. Cl. ..... 132/213.1; 132/144; 132/148; 132/279

(58) Field of Classification Search ..... 132/213, 132/213.1, 214, 144, 148, 273, 275–277, 132/279
See application file for complete search history.

(56) References Cited

U.S. PATENT DOCUMENTS 673,098 A * 4/1901 Tissier ..... 132/133
1,609,208 A * 11/1926 Schneeberger et al. ..... 132/122
3,279,055 A * 10/1966 Penn ..... 30/30
3,608,565 A 9/1971 Ensign ..... 132/9
5,012,830 A * 5/1991 Vaccaro et al. ..... 132/213.1
5,597,000 A 1/1997 Gerber ..... 132/279
5,865,188 A 2/1999 Marquez ..... 132/132
6,135,123 A 10/2000 Grssi et al. ..... 132/213
6,267,119 B1 7/2001 Silva ..... 132/213
6,421,920 B1 7/2002 Jensen ..... 30/134

* cited by examiner

*Primary Examiner*—Kevin Shaver
*Assistant Examiner*—Stephanie Willatt
(74) *Attorney, Agent, or Firm*—Goldstein Law Offices PC

(57) ABSTRACT

A hair cutting guide, for use by a hairdresser in cutting the hair of a person using scissors, having a pair of guide halves that are hingeably attached and selectively enter an open position and a closed position. Each of the guide halves have a plurality of teeth arranged along its longitudinal edges. The teeth have an inner surface that face the inner surfaces of the teeth in the other guide halve when the guide is in the closed position. Combs extend perpendicularly to the inner surfaces such that hair is extended transversely between the longitudinal edges and is held in place by the combs when the guide is closed. Straight cutting and point cutting is carried out by cutting with the scissors adjacent to the teeth along one of the longitudinal edges when the guide is in the closed position.

7 Claims, 3 Drawing Sheets

HAIR TRIMMING GUIDE

BACKGROUND OF THE INVENTION

The invention relates to a hair trimming guide. More particularly, the invention relates to a trimming guide that allows for easy and accurate trimming of the forwardly growing hair on a person's head known generally as the "bangs".

Cutting hair is more like an art than a science. For this reason, countless techniques have been developed by hairdressers for cutting hair in an even and stylish pattern. Every hairdresser chooses their favorites from among these techniques, and employs it in everyday practice.

One common technique is to grasp a group of hair between two fingers, and then cut parallel to the longitudinal surfaces of the fingers. This technique allows hair to be cut at a consistent length. Since conventional haircutting scissors are extremely sharp, this can be a dangerous practice.

At times, however, it is desirable to have such a group of hair cut at varying lengths. To do this, the scissors are angled inward toward the fingers to execute "point cutting". The danger of cutting toward the fingers is especially acute when point cutting. Accordingly, many hairdressers cut in such a manner without the benefit of the "reference line" created by the fingers. With practice, such cutting can be relatively consistent. Rarely, however, is the cut completely even.

U.S. Pat. No. 3,608,565 to Ensign; U.S. Pat. No. 5,597,000 to Gerber; U.S. Pat. No. 6,135,123 to Grassi; and U.S. Pat. No. 6,421,920 to Jensen disclose various devices that clamp or hold the hair for various hairstyling operations. U.S. Pat. No. 6,267,119 to Silva discloses a haircutting guide-comb that is available in various embodiments to suit various haircutting needs. Silva, however, fails to disclose a cutting guide that is configured to address multiple haircutting needs with a single cutting guide.

While these units may be suitable for the particular purpose employed, or for general use, they would not be as suitable for the purposes of the present invention as disclosed hereafter.

SUMMARY OF THE INVENTION

It is an object of the invention to produce a hair trimming guide that allows the hair to be evenly cut as desired. Accordingly, the trimming guide creates a reference that allows the hair to be cut as intended.

It is another object of the invention to provide a hair trimming guide that securely holds the hair during cutting. Accordingly, the hair trimming guide clamps onto the hair, and holds the hair securely in place transversely across the guide with a plurality of combs, so that the hair remains stationary with respect to the guide as the hair is cut between the ends of the trimming guide.

It is a further object of the invention to provide a hair trimming guide that allows both straight and point cutting. Accordingly, the guide provides a plurality of teeth—allowing a person cutting him or another's hair to follow the teeth edge surfaces for point cutting, or cut across the teeth points for straight cutting.

It is a further object of the invention to provide a hair trimming guide that allows hair to be trimmed along an arc—either directly along the arc or pointed while following a generally arced configuration. Accordingly, the teeth are positioned along one of the longitudinal sides such that the points of said teeth follow an arc. The hairdresser can create pointed cuts in a generally arced configuration by cutting into the teeth, or can create a smooth arc by cutting across the points.

The invention is a hair trimming guide, for use by a hairdresser in cutting the hair of a person using scissors, having a pair of guide halves that are hingeably attached and selectively enter an open position and a closed position. Each of the guide halves have a plurality of teeth arranged along its longitudinal edges. The teeth have an inner surface that face the inner surfaces of the teeth in the other guide halve when the guide is in the closed position. Combs extend perpendicularly to the inner surfaces such that hair is extended transversely between the longitudinal edges and is held in place by the combs when the guide is closed. Straight cutting and point cutting is carried out by cutting with the scissors adjacent to the teeth along one of the longitudinal edges when the guide is in the closed position.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
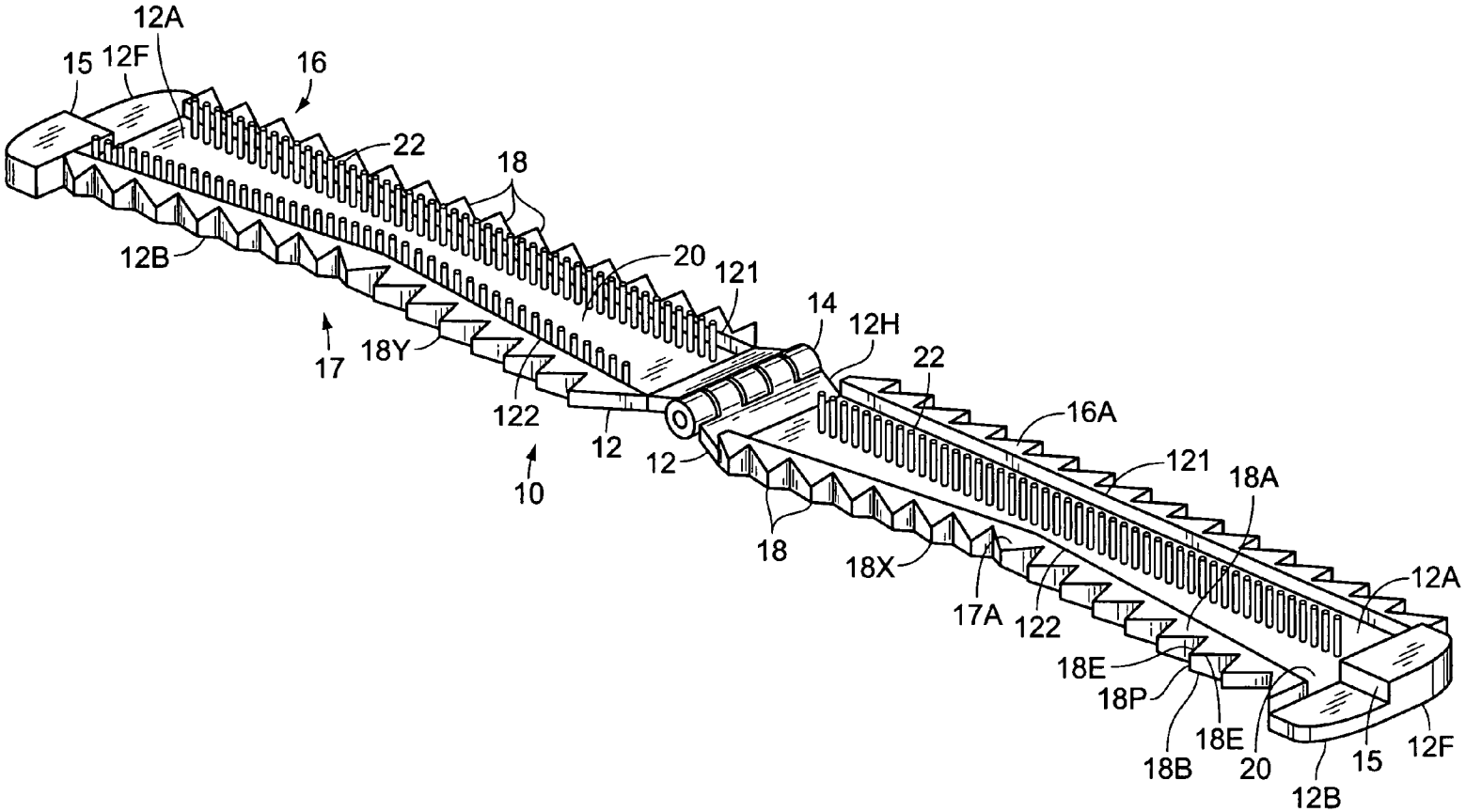
FIG. 1 is a diagrammatic perspective view, illustrating the guide in the open position, wherein the guide halves are substantially parallel and coextensive, showing the internal combs thereof.

FIG. 1 illustrates a hair trimming guide 10 having a pair of guide halves 12, each having a hinged end 12H and a free end 12F, a first edge 121 and a second edge 122, an inside surface 12A and an outside surface 12B. The guide halves 12 are pivotally attached together with a hinge 14 that allows the guide 12 to enter a fully open position, wherein the guide halves 12 are substantially parallel, coextensive, and extend away from each other at the hinge 14; and a closed position, wherein the guide halves 12 are substantially parallel, extend from the hinge 14 in the same direction, their inside surfaces 12A face each other, and the guide halves 12 and overlap with a slight gap between their inside surfaces 12A for allowing hair to extend transversely therethrough, between the first edge 121 and second edge 122. The hair cutting guide 10 is illustrated in a fully open position in FIGS. 1 and 2, and a closed position in FIG. 3.

The guide halves 12 each have a clasp part 15 at their free ends 12F. When the guide halves 12 are brought into the closed position, the clasp parts 15 mate to hold the guide 10 in the closed position.

Figure 2:
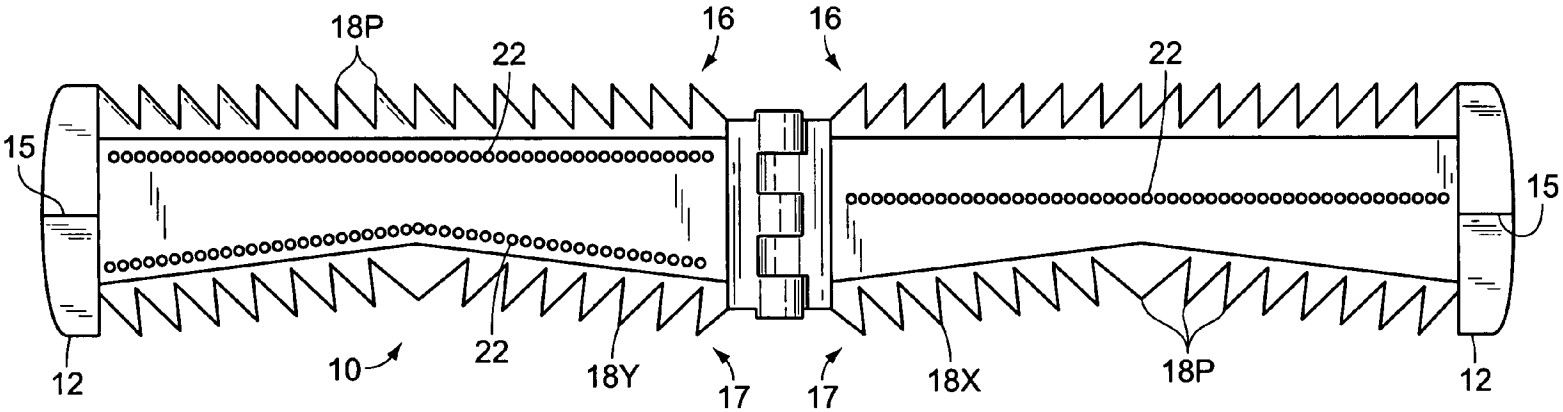
FIG. 2 is a top plan view of the guide in the open position, illustrating symmetry of the teeth about the hinge axis.
Figure 3:
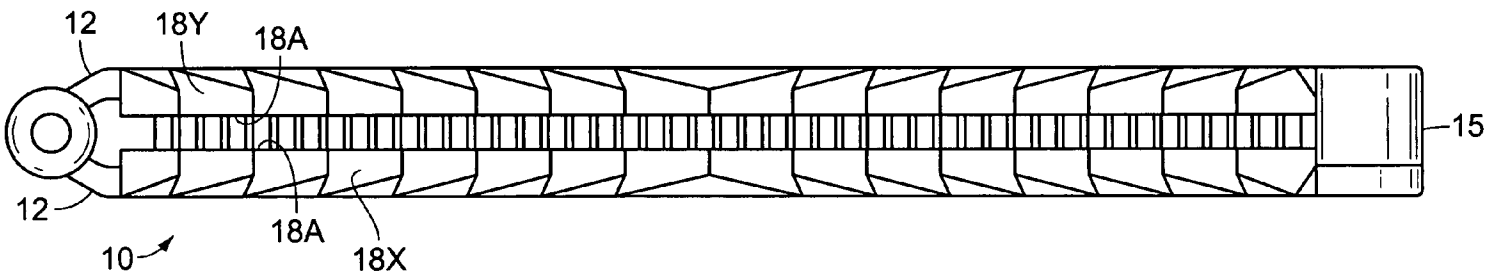
FIG. 3 is a front elevational view of the guide in the closed position, wherein the guide halves are substantially parallel and are slightly separated with the combs traversing the gap therebetween.

The hair trimming guide 10 has a first teeth arrangement 16 on the first edge 121 and a second teeth arrangement 17 on the second edge 122. Each of the teeth arrangements 16, 17 have a plurality of teeth 18, each tooth 18 having an inner tooth surface 18A, a point 18P, tooth side edges 18E and an outer tooth surface 18B. Referring to FIGS. 2 and 3 simultaneously, each tooth 18X on one of the guide halves 12 has a complementary tooth 18Y on the other guide halve 12, such that the tooth 18X and the complementary tooth 18Y are aligned when the guide 10 is in the closed position, wherein the inner tooth surfaces 18A face each other and are separated by a uniform gap distance.

Referring again to FIG. 1, all of the teeth 18 on each guide half 12 within one of the teeth arrangements 16, 17 share a common teeth arrangement inner surface 16A, 17A. Each guide half has a middle surface 20 that is recessed between the teeth arrangement inner surfaces 16A, 17A. A plurality of combs 22 extend longitudinally across the guide halves 12, extending perpendicularly from the middle surface 20 and from the inside surface 12A. In particular, one of the guide halves 12 has two combs 22, and the other guide halve 12 has one comb 22 that extends between the combs 22 of the other guide halve when the guide 10 is in the closed position. Accordingly, once a group of hair 50 is extended transversely through the guide 10 as in FIG. 4, across its inside surface 12A such that the hair extends across one of the inner tooth surfaces 18A, across the middle surface 20, and across the other of the tooth surfaces 18A on one of the guide halves 12, the other guide half 12 is clamped down thereupon to hold the hair securely in place. To facilitate the same, the combs 20 hold the hair in place. In fact, once all three combs grab the hair 50, it is difficult to move the hair transversely through the guide 10. Referring to FIG. 3, when the guide 10 is in the closed position, a small gap remains between the inner tooth surfaces 18A to allow the hair to extend through the guide 10 while the guide is closed.

Referring now to FIG. 2, it is apparent that the first teeth arrangement 16 is for cutting along a straight line, such that all of the points 18P are linearly aligned. The second teeth arrangement 17 is for arced cutting, such that the points 18P are arranged along an inward arc. The present invention allows either style of cutting to be performed. The hairdresser can alternate between the two by simply turning the guide 10 around and using the other teeth arrangement. In addition, with either of the teeth arrangements 16, 17 the hairdresser can either perform straight cuts by cutting across the points 18P, or perform "point cutting", where the hairdresser angles the scissors inwardly between the adjacent teeth 18 along the alternating side edges 18E of adjacent teeth.

Figure 4:
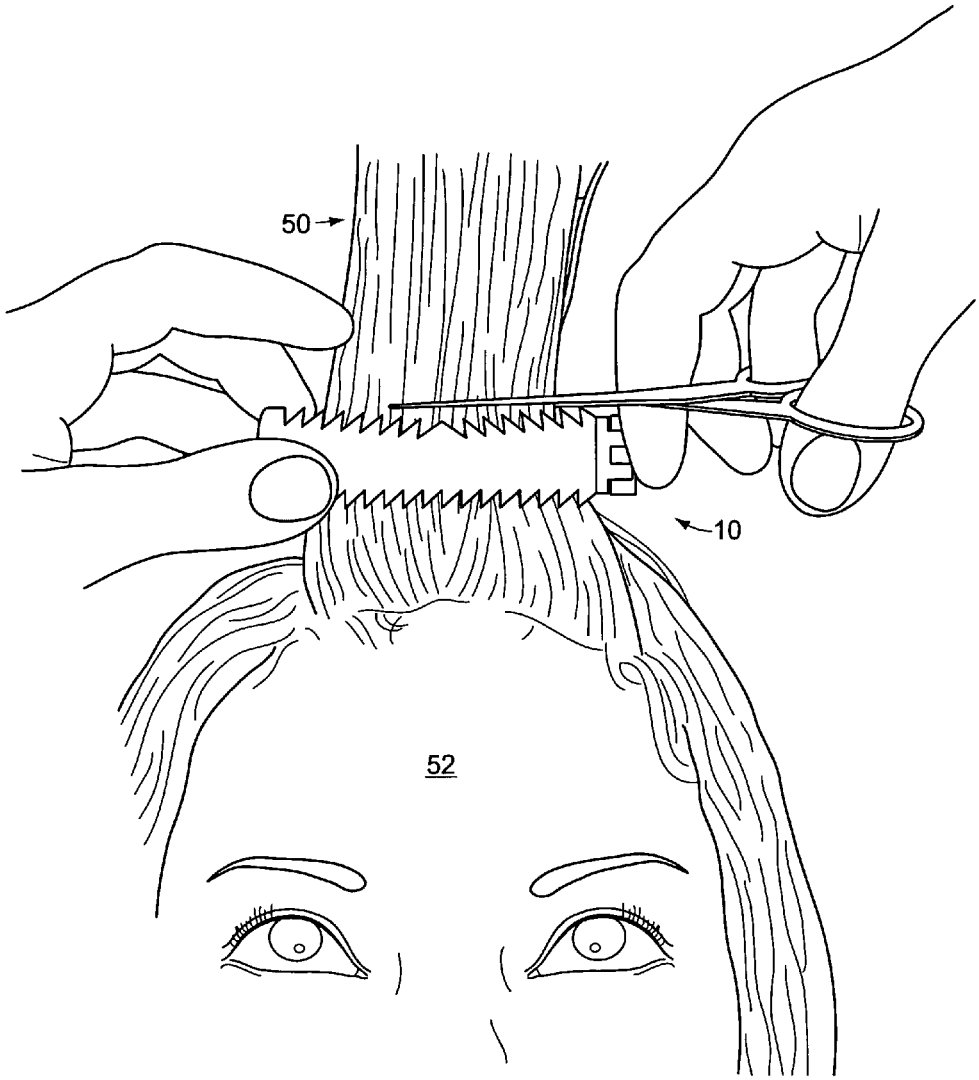
FIG. 4 is a front elevational view, illustrating the guide in use, wherein a portion of a person's bangs extend through the guide and are held firmly therein, and wherein a hairdresser is creating an arced cut by maneuvering the scissors across the points of the arced teeth set.

As illustrated in FIG. 4, the hair 50 is inverted upward for cutting. The guide 10 may be used, however, with the hair extending downward along the forehead 52, as the guide teeth are tapered so that the guide can be angled against the forehead by resting the outer tooth surfaces against the forehead.

In conclusion, herein is presented a hair trimming guide that securely holds the hair while it is trimmed in a consistent fashion. The invention is illustrated by example in the drawing figures, and throughout the written description. It should be understood that numerous variations are possible, while adhering to the inventive concept. Such variations are contemplated as being a part of the present invention.

What is claimed is:

1. A hair cutting guide, for use by a hairdresser when cutting the hair of a person with scissors, comprising:

a pair of guide halves, the guide halves each having a hinged end and a free end, the guide halves each having a longitudinally extending first edge and a longitudinally extending second edge, each guide half having a pair of teeth arrangements including a plurality of teeth arranged longitudinally along the first edge and the second edge, said teeth having points oriented transversely outwardly having an inside surface, the teeth on each of the guide halves share a common inside surface extending transversely between the first edge and second edge, the points of the teeth in one of the teeth arrangements in each guide half are arranged in a straight line while the teeth in the other of the teeth arrangements in said guide half are aligned to follow an arc, the guide halves are connected at the hinged end so that they are capable of entering an open position, and a closed position wherein the guide halves are substantially parallel and the common inside surfaces face each other and are separated by a gap distance, for allowing a quantity of hair to extend transversely between the guide halves for allowing the hair to be cut with the scissors, adjacent to the teeth; and at least one comb on each of the guide halves extending perpendicularly from its inside surface, the combs extend parallel to each other such that when the guide is in the closed position each comb traverses the gap and engages the other guide halve so that together the combs hold the hair as it is cut.

2. The hair cutting guide as recited in claim 1, wherein the free end of each of the guide halves has a clasp part; and wherein when the guide halves are brought together their clasp parts are mated to hold the guide in the closed position.

3. The hair cutting guide as recited in claim 2, wherein one of the guide halves has two combs and the other guide half has one comb that extends between said two combs when the guide is in the closed position.

4. The hair cutting guide as recited in claim 3, wherein each of the teeth on one of the guides has a complementary tooth on the other of the guides such that said teeth are aligned, their inner surfaces face each other, and their inner surfaces are separated by the gap distance when the guide is in the closed position.

5. A hair cutting guide method, for cutting a person's hair by a hairdresser using scissors, and a cutting guide having a pair of guide halves hingeably attached together, each guide halve has a first longitudinal edge and a second longitudinal edge, the teeth in a first teeth arrangement on the first longitudinal edge and a second teeth arrangement on the second longitudinal edge, the points of the teeth in the first teeth arrangement are aligned on a straight line and the points of the teeth on the second teeth arrangement are aligned on an arc, each of the teeth having an inner surface, side edges, and a point, the guide having at least one comb extending perpendicularly on each other guide halves;

extending the hair transversely across one of the guide halves;

grasping the hair with the combs by closing the guide halves by aligning the teeth of the two guide halves such that their inner surfaces are substantially parallel and are separated by a consistent gap distance by bringing their inner surfaces substantially together;

cutting the hair with the scissors by cutting adjacent to the teeth longitudinally adjacent to one of the first longitudinal edge and second longitudinal edge.

6. The hair cutting method as recited in claim 5, wherein the step of cutting adjacent to the teeth further comprises cutting longitudinally adjacent to one of the first longitudinal edge and the second longitudinal edge, and wherein the step of cutting adjacent to the teeth further comprises straight cutting by cutting across the teeth points with the scissors.

7. The hair cutting method as recited in claim 5, wherein the step of cutting adjacent to the teeth further comprises point cutting by cutting inwardly along the tooth side edges with the scissors.

* * * * *